US006578732B1

(12) United States Patent
Mabry

(10) Patent No.: US 6,578,732 B1
(45) Date of Patent: Jun. 17, 2003

(54) CHEWING GUM STICK DISPENSER

(75) Inventor: Hellen Mabry, 852 W. Beach Ave., Unit 3, Inglewood, CA (US) 90302

(73) Assignee: Hellen Mabry, Inglewood, CA (US)

( * ) Notice: Subject to any disclaimer, the term of this patent is extended or adjusted under 35 U.S.C. 154(b) by 0 days.

(21) Appl. No.: 10/017,331

(22) Filed: Dec. 13, 2001

Related U.S. Application Data

(60) Provisional application No. 60/258,968, filed on Jan. 2, 2001.

(51) Int. Cl.[7] ..... B65H 1/08
(52) U.S. Cl. ..... 221/60; 221/279
(58) Field of Search ..... 221/45, 49, 52, 221/53, 56, 59, 60, 58, 279, 232, 268

(56) References Cited

U.S. PATENT DOCUMENTS 4,465,208 A 8/1984 Buban et al.
5,056,683 A 10/1991 O'Brien et al.
5,197,631 A * 3/1993 Mishima ..... 221/52
5,353,956 A 10/1994 Wilson
5,649,642 A 7/1997 Mabry et al.

* cited by examiner

*Primary Examiner*—Kenneth W. Noland
(74) *Attorney, Agent, or Firm*—Bissell & Bissell; Henry M. Bissell, III; Henry M. Bissell, IV

(57) ABSTRACT

A chewing gum stick dispenser includes a generally box-shaped container having a slot therein for dispensing a single stick of gum. A scissoring pair of swing arms utilizes tensioning means for urging the contained sticks of gum toward an operator wall. The operator wall retains a slidable operator having a seat adapted to engage a single stick of gum and push it partially through the dispensing slot. The container further includes a pivoted cap which can be opened to provide easy refilling of the container.

17 Claims, 4 Drawing Sheets

CHEWING GUM STICK DISPENSER

CROSS-REFERENCE TO RELATED APPLICATION

This application claims the benefit of U.S. Provisional Application No.: 60/258,968, filed Jan. 2, 2001.

BACKGROUND OF THE INVENTION

1. Field of the Invention

This invention relates generally to dispensers for chewing gum or bubble gum, more particularly to personal dispensers for stick chewing gum.

2. Description of the Related Art

Personal dispensers for chewing gum or bubble gum are known in the prior art. U.S. Pat. No. 4,465,208 to Buban et al. discloses a dispenser with a cover whose central region is cut away to afford access to a stick of gum which is urged against the cover by a spring-mounted platform. The user dispenses the gum by placing his thumb against the stick of gum and pushing it toward a slot at the end of the dispenser. The gum is susceptible to loss of freshness and to damage from moisture or foreign objects due to the exposure of the gum through the cut away region.

U.S. Pat. No. 5,056,683 to O'Brien et al. discloses a cardboard dispenser with a paper sling which extends from the inside of the dispenser through the dispensing slot. As the user pulls on the sling, a stick of gum is carried by the sling through the slot. Because this container is made of cardboard, the gum contained within is more susceptible to moisture damage than it would be in a container constructed of a non-permeable material, such as plastic. Additionally, a cardboard container lacks durability. Because the dispenser contains no mechanism such as a spring and platform to urge the gum against a wall of the dispenser, the gum rests loosely within the container and can fall out of the dispensing slot when it is not intended to be dispensed.

U.S. Pat. No. 5,353,956 to Wilson discloses a dispenser with a hinged lid. The user flips open the lid, then slides an ejector with his or her thumb to expose all of the sticks of gum contained in the dispenser at once. The user must then pull the desired stick or sticks of gum away from the other sticks, tap the remaining sticks back into place if they have become dislodged by the action of pulling away the desired stick, then close the lid.

U.S. Pat. No. 5,649,642, of which I am a named inventor, discloses a gum dispenser in the form of a rectangular parallelopiped-shaped container having space for a plurality of sticks of gum between a movable platform and one of the container walls. Adjacent the wall is a slot-shaped opening through which a stick of gum can be ejected. The platform is urged in the direction of the wall by a spiral spring. The apparatus also contains a slidable operator in the vicinity of the wall which is mounted so as to engage only the single stick of gum which is in position to be ejected. Sliding the operator toward the opening propels the uppermost stick of gum in the direction of the opening and through it by a sufficient distance to permit it to be grasped and removed from the dispenser. Retracting the operator permits the platform, driven by the coil spring, to move the group of sticks of gum in the direction of the wall, thereby positioning the new uppermost stick of gum so that it can be ejected by the next forward movement of the operator.

The chewing gum dispenser of the present invention is an improvement on the dispenser disclosed in my prior patent. It has been found in practice that the spring-and-platform arrangement which is employed for positioning the sticks of gum stored within the dispenser for dispensing at the option of the user is not as stable as might be desired. In use, it is my experience that the dispenser jams on occasion, thus precluding the user from dispensing a stick of gum, as desired. This problem is in part associated with the construction and configuration of the operator which applies an unbalanced force on the sticks of gum within the dispenser during operation to dispense the uppermost stick.

SUMMARY OF THE INVENTION

The gum dispenser of the present invention includes a substantially box-shaped container in the general form of a rectangular parallelopiped. The container has opposed first and second side walls oriented to be parallel with the sticks of gum stored therein. Third and fourth side walls extend between the first and second walls and a pair of end walls completes the structure of the container. One of these end walls defines a slot or opening slightly exceeding the width and thickness of a stick of gum for the ready dispensing of one stick at a time through that opening.

The box-shaped container encompasses a pair of swing arms, each being hinged to the first wall of the container and interlocking in a scissoring fashion. A tensioning device, in the form of a spring, rubber or elastic band, extends between the swing arms and draws them together. The swing arms are constructed and configured to provide a pair of opposing ends which support the sticks of gum within the container at positions adjacent to the ends thereof, thereby providing a more balanced force in urging the sticks of gum into position for dispensing. When sticks of chewing gum are placed between the swing arms and the second wall of the container, the tensioning device draws the swing arms together and thereby urges the sticks of gum against each other and toward the second wall of the container.

The dispenser includes a top panel or end wall having a slot at its junction with the second wall, through which slot the sticks of gum are individually dispensed. The second wall, or operator wall, of the container slidably mounts an operator to provide association of the manual movement of the operator with the dispensing of an individual stick of chewing gum. When a user slides the operator toward the dispensing slot in the end wall, a seat engages a leading stick of gum and causes the stick of gum to partially emerge through the dispensing slot in the container. In this manner each stick of chewing gum is individually dispensed. When the operator is drawn back toward the base panel, the operator seat is repositioned to receive the next stick of chewing gum.

The base panel of the container is configured with a platform upon which the sticks of chewing gum rest. In its retracted position, the seat is positioned at or slightly below the height of the platform, allowing the leading stick of gum to advance and be received by the seat.

The dispenser is preferably constructed of plastic or other similar rigid, non-permeable, durable material.

Due to the fact that the only fixed opening in the dispenser is the dispensing slot, the dispenser helps to protect the gum from deterioration due to moisture or foreign objects, and the freshness of the gum is prolonged. Because the gum is securely urged against the wall of the dispenser, the gum will not fall out of the dispenser when it is undesirable for it to do so. Because the operator seat engages only the leading stick of gum, only one piece of gum is dispensed at a time.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Figure 1:
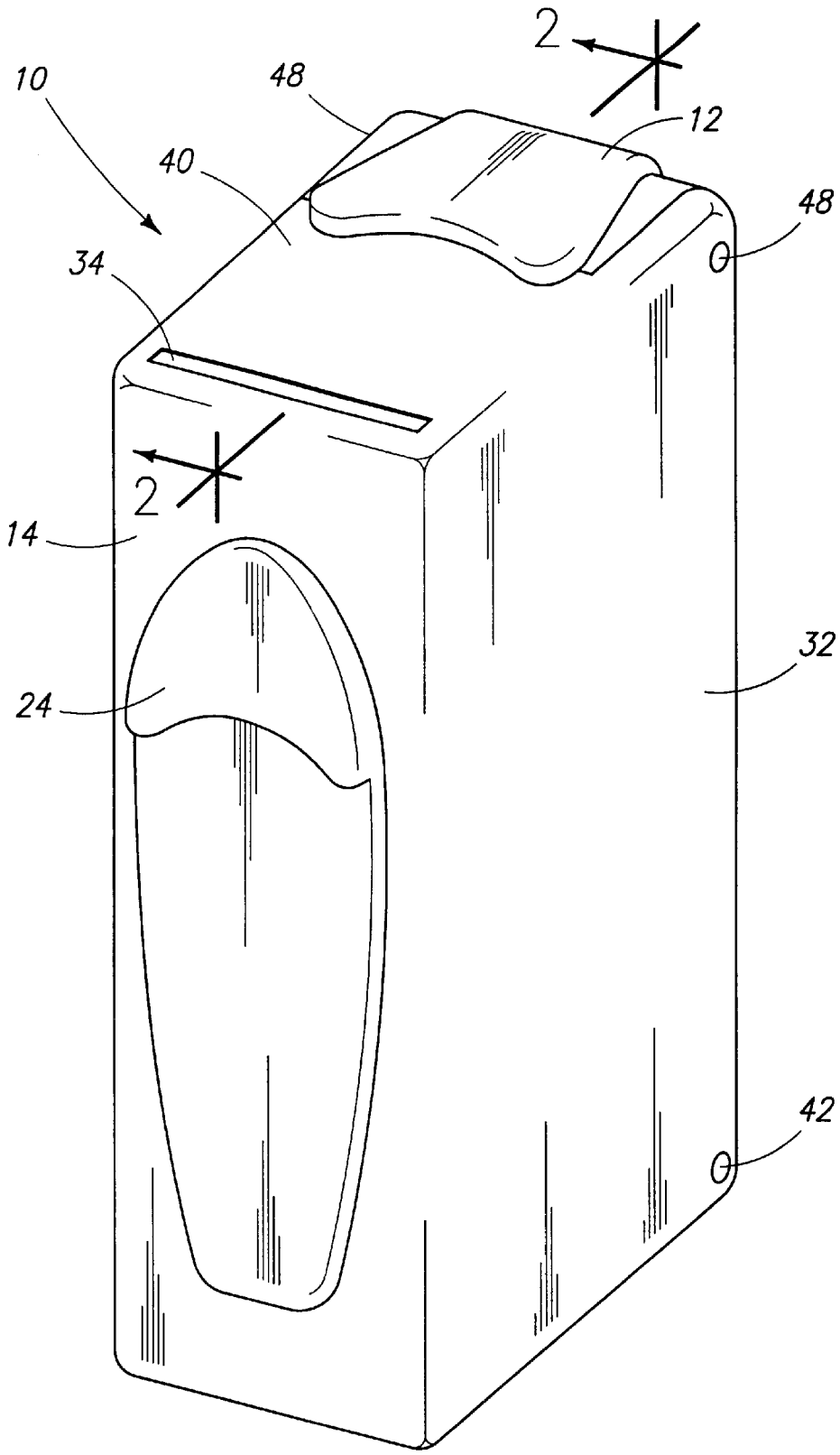
FIG. 1 is a schematic perspective view of the dispenser of the present invention.
Figure 2:
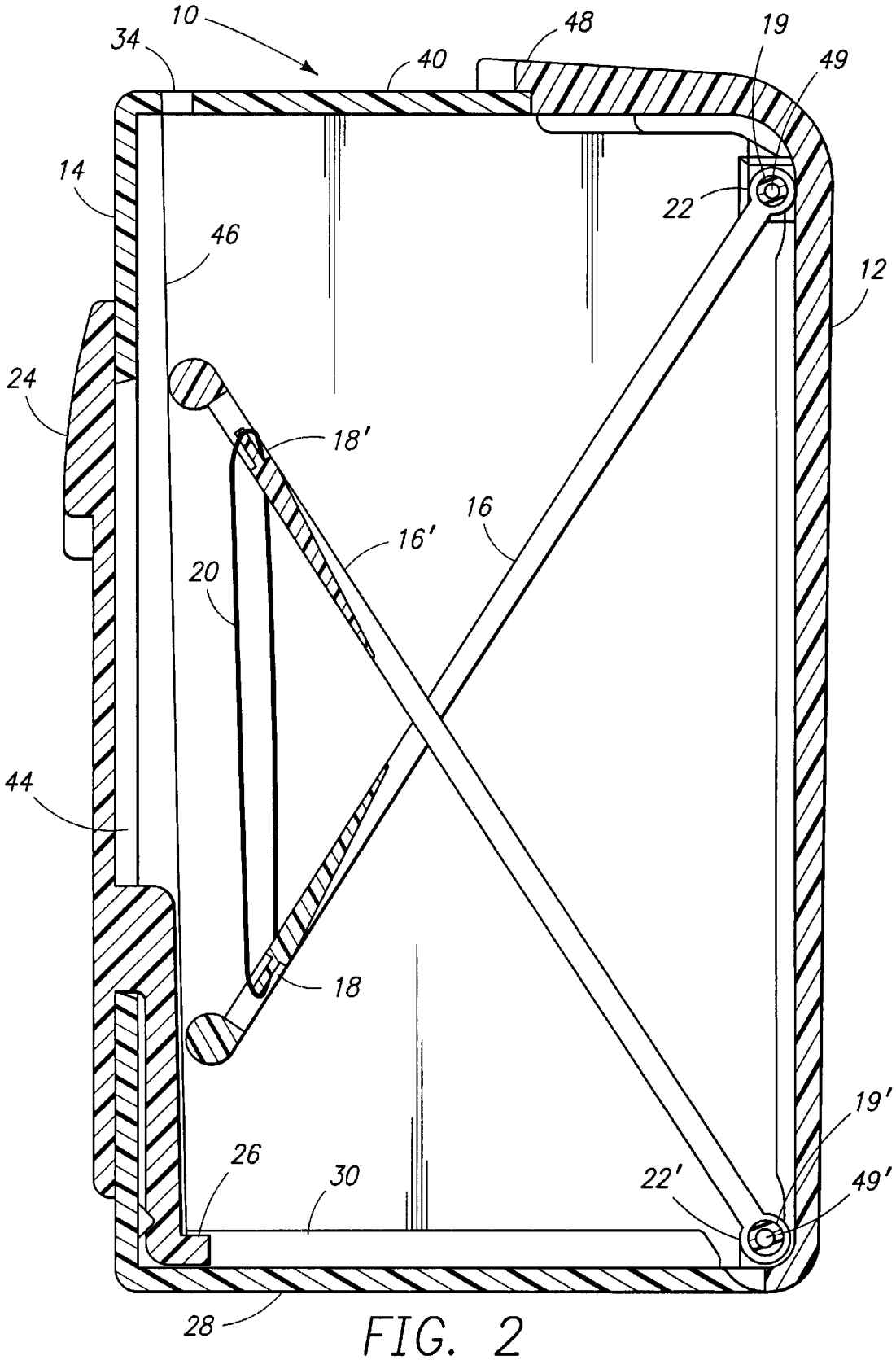
FIG. 2 is a cross-sectional, plan view of the dispenser of FIG. 1 with the operator in a retracted position and the swing arms fully extended.

In FIGS. 1 and 2, the dispenser of the present invention is shown comprising a container 10 having a generally rectangular box shape. A hinged first wall or cap wall 12 provides access to the contents of the dispenser. Cap 12 may be outfitted with a tab 48 to increase the ease of opening the container for refilling with sticks of gum. The container 10 has a top panel 40, side walls 32, second wall (or operator wall) 14 adapted to receive an operator 24. Dispenser slot 34 is adapted to deliver a stick of gum for dispensing through slot 34 in top panel 40, although slot 34 may be located in any desired wall of the dispenser. First wall, or cap, 12 hinges open via cap hinge 42 to enable access to the interior of the container 10 for filling or refilling with gum sticks.

FIG. 2 is a cross-sectional view of the dispenser of FIG. 1, taken along the plane 2—2. Container 10 has a first wall (or cap) 12 attached to a second (or operator) wall 14 and contains swing arms 16 and 16'. Swing arms 16 and 16' are mounted at opposite ends of cap wall 12 by way of hinge pivots 22.

Figure 2A:
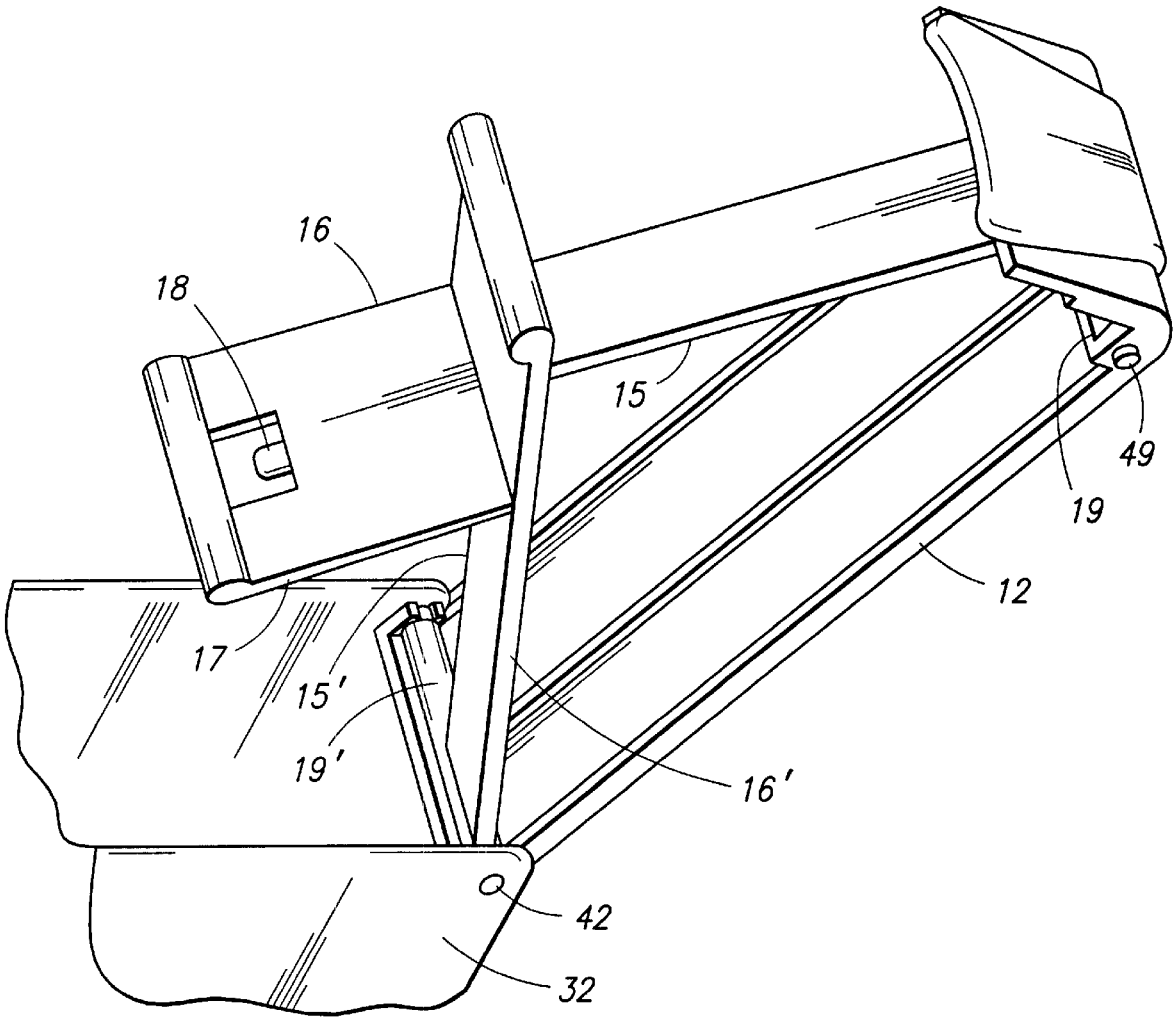
FIG. 2A is a schematic view showing the swing arms installed in the cover of the dispenser.
Figure 3:
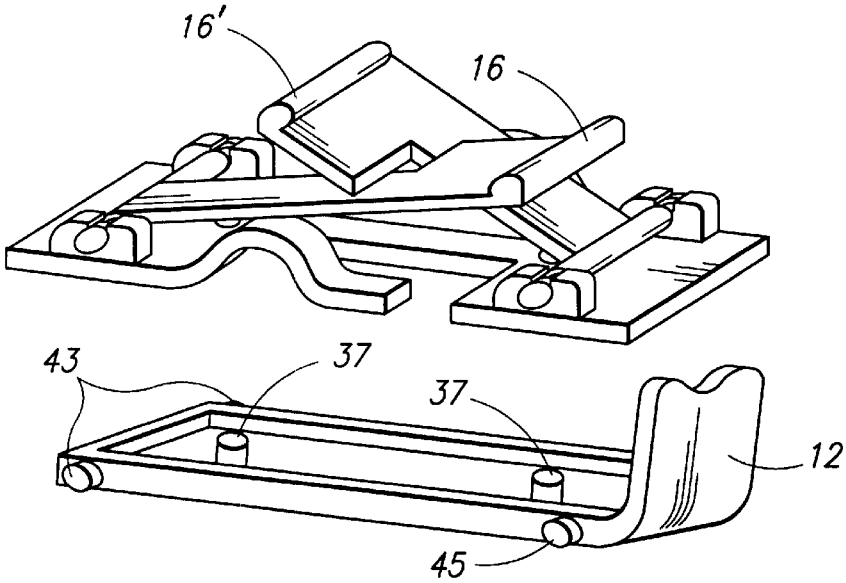
FIG. 3 is a partially disassembled view of the operative portion of the dispenser of FIG. 1 showing an alternative embodiment thereof.

One swing arm 16 is depicted in FIG. 2A as having a wide end portion 17 in which the hook 18 is located and a narrow portion 15. Arm 16' is identical to arm 16 but is turned over from the way arm 16 is depicted in FIG. 2A. When the two swing arms 16, 16' are mounted as shown in FIG. 3 the narrow portions 15 slide past each other and the wider portions 17 limit the movement of the two swing arms, relative to each other. At the base of the swing arm 16 is an axle member 19 with two end portions 21 of reduced diameter at opposite ends of the axle 19. As indicated in FIG. 2, the axle member 19 of the swing arm 16 is rotatably mounted in the upper hinge pivot 22.

The corresponding elements of the swing arm 16' are designated by like reference numerals primed. The swing arms 16, 16' are installed by positioning the axle members 19, 19' within the hinge pivots 22, 22', respectively. The cap wall is pivotably mounted to the container 10 by snapping the pin ends 49' of swing arm 16' into the holes 42 (FIG. 1) on opposite sides of the container 10, thus permitting the cap wall 12 to rotate freely about the hinge point 42. However, when the cap 12 is moved to the closed position, as shown in FIG. 2, the pin ends 49 of the swing arm 16 snap into the openings 48 (FIG. 1) to retain the cap 12 in the closed position. The fit of the pin ends 49 of the axle 19 of swing arm 16 are sufficiently loose that the cap 12 may readily be opened and closed with the pins 49 slipping in and out of the openings 48. In the assembled dispenser, the swing arms as noted are mounted in the hinge pivots 22, 22'.

In the embodiment of FIG. 2, top panel 40 contains dispensing slot 34 for dispensing sticks of gum from the container interior. Tensioning means 20 extends between swing arms 16 and 16', as shown, and may comprise a rubber band, elastic band or spring member retained by hooks 18, 18'.

In use, sticks of gum are positioned between second wall 14 and the ends of swing arms 16 and 16'. Tensioning means 20 biases the swing arms 16 and 16' toward each other in a scissoring action, resulting in the urging of the gum sticks toward operator wall 14 and guide 46. Guide 46 of operator wall 14 serves to direct a leading stick of gum toward dispensing slot 34. Operator wall 14 contains an aperture 44 through which operator 24 extends. Operator 24 has a seat 26 adapted for receiving one end of a stick of gum for dispensing through slot 34. Base panel 28 and top panel 40 separate first wall 12 from operator wall 14. Base panel 28 has a platform 30 in the form of a pair of spaced apart ridges formed to serve as a guide for sticks of gum to be dispensed. When retracted, seat 26 of operator 24 rests at or below the guide surface of platform 30.

Figure 4:
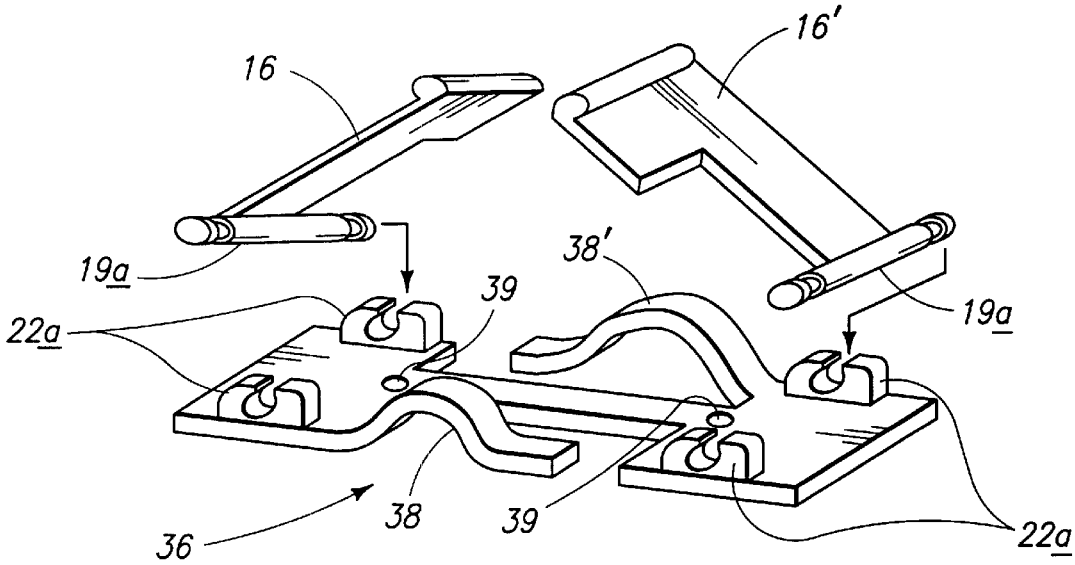
FIG. 4 is an exploded view of the operative portion of FIG. 3.

FIG. 3 is a partially disassembled view of an alternative biasing arrangement for the dispenser of FIG. 1. FIG. 4 shows an exploded view of the components of the biasing arrangement of FIG. 3. In these figures, the swing arms 16, 16', are mounted on a preformed mounting plate 36 which itself is mounted on the cap member 12 by means of projections 37 on the cap 12 fitting within mounting holes 39. The mounting plate 36 may, if desired, be formed integrally with the cap 12. Mounting plate 36 is formed with integral spring members 38, 38' which, as shown in FIG. 3, bear against the swing arm 16, 16' to develop a biasing force urging the outer ends of the swing arms in the direction of the sticks of gum stored within the container 10 to provide the desired support therefor. Swing arm mounting plate 36 may have hinge points 22 for pivotally attaching swing arms 16 and 16'. Spring members 38 and 38' may be of a leaf spring or other variety. Swing arm mounting plate 36 is attached to cap 12. In the arrangement of FIGS. 3 and 4, where axle elements 19*a* of the swing arms 16, 16' are mounted in hinge points 22*a* which are part of the mounting plate 36, the cap 12 is provided with pin projections 43 and 45 for insertion into holes 42 and 48, respectively of FIG. 1.

Although there have been described hereinabove various specific arrangements of a CHEWING GUM STICK DISPENSER in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A dispenser for dispensing sticks of chewing gum, said dispenser comprising:

a generally box-shaped container having respective generally parallel opposed cap wall and operator wall, first and second side walls, and top panel and base panel;

a pair of swing arms having respective first ends pivotably hinged to opposite ends of said cap wall;

biasing means extending between said swing arms for urging the second ends of said swing arms toward each other and away from said cap wall; and an operator slidably engaged within the dispenser to extend through an aperture contained in said operator wall, said operator being adapted to engage one end of a single stick of gum for dispensing said stick of gum through an exit slot defined in said container.

2. The dispenser of claim 1 wherein each of said swing arms is generally L-shaped with a wide portion adjacent said second end for interlocking with the other L-shaped swing arm and a narrow portion extending from the wide portion to the first end for overlapping the narrow portion of the other swing arm to permit limited relative movement of the swing arms between the cap wall and the point where they interlock.

3. The dispenser of claim 1 wherein said cap wall includes a pair of hinge pivots adjacent opposing ends of said cap wall for pivotably mounting said swing arms relative to said cap wall.

4. The dispenser of claim 1 wherein said cap wall is pivotably hinged to said container, whereby one or more sticks of gum may be placed in the container when the cap wall is pivoted to open the container.

5. The dispenser of claim 1 wherein said cap wall has an integrally formed tab for facilitating the opening of said cap wall.

6. The dispenser of claim 1 wherein each of said swing arm first ends includes an axle member having opposing cylindrical pin ends for mating with corresponding mounting holes in said side Walls.

7. The dispenser of claim 1 wherein said operator wall further includes a guide on the interior of said container, said guide being located to guide a leading stick of gum toward said exit slot.

8. The dispenser of claim 7 wherein said base panel further includes a platform adjacent the interior of said container and biased to urge the sticks of gum toward said operator wall for dispensing.

9. The dispenser of claim 8 wherein said base panel platform comprises a pair of spaced-apart ridges formed to guide said operator as it is retracted toward said base panel to a level at least even with said platform.

10. The dispenser of claim 2 wherein the wide portion of each L-shaped swing arm defines an aperture with a projecting tongue therein for securing said biasing means to the corresponding swing arm.

11. The dispenser of claim 10 wherein said biasing means comprises an elastic band.

12. The dispenser of claim 10 wherein said biasing means comprises a spiral spring.

13. The dispenser of claim 6 wherein said biasing means comprise a pair of spring members affixed to and extending from a mounting plate shaped to fit along said cap wall and to be attached thereto, said spring members being positioned to bear against said swing arms to urge the second ends of said L-shaped arms toward each other.

14. The dispenser of claim 13 wherein said spring members comprise leaf-type springs.

15. The dispenser of claim 13 wherein said spring members are formed as integral parts of said mounting plate.

16. The dispenser of claim 13 wherein said mounting plate includes socket portions for receiving the projecting pin ends of said swing arms for pivotably supporting the first ends of said L-shaped swing arms.

17. The dispenser of claim 13 wherein said mounting plate includes a plurality of apertures for matingly receiving corresponding projecting members on the inner side of said cap wall.

* * * * *